US008966794B2

(12) United States Patent
Kuromitsu et al.

(10) Patent No.: US 8,966,794 B2
(45) Date of Patent: Mar. 3, 2015

(54) TRAY UNIT AND CARD HOLDER

(71) Applicant: Panasonic Healthcare Holdings Co., Ltd., Tokyo (JP)

(72) Inventors: Keiichi Kuromitsu, Osaka (JP); Mitsuaki Ishikawa, Ehime (JP); Chikara Takauo, Ehime (JP); Tooru Kusanagi, Ehime (JP)

(73) Assignee: Panasonic Healthcare Holdings Co., Ltd., Tokyo (JP)

( * ) Notice: Subject to any disclaimer, the term of this patent is extended or adjusted under 35 U.S.C. 154(b) by 0 days.

(21) Appl. No.: 14/167,205

(22) Filed: Jan. 29, 2014

(65) Prior Publication Data

US 2014/0144807 A1 May 29, 2014

Related U.S. Application Data

(63) Continuation of application No. PCT/JP2012/005045, filed on Aug. 8, 2012.

(30) Foreign Application Priority Data

Sep. 1, 2011 (JP) ..... 2011-190317

(51) Int. Cl.
*G09F 1/00* (2006.01)
*G09F 3/16* (2006.01)
(Continued)

(52) U.S. Cl.
CPC *B65D 85/00* (2013.01); *G09F 3/20* (2013.01); *G09F 3/204* (2013.01); *B65D 21/0213* (2013.01); *B65D 25/205* (2013.01); *B65D 1/34* (2013.01)
USPC ..... 40/124.06; 40/658; 40/666; 206/557

(58) Field of Classification Search
CPC ..... G09F 3/16
USPC ..... 40/124.06, 658, 642.02, 651, 666; 206/557; 24/545
See application file for complete search history.

(56) References Cited

U.S. PATENT DOCUMENTS

| | | | | |
|---|---|---|---|---|
| 2,564,517 | A * | 8/1951 | Beals | 40/658 |
| 7,874,088 | B2 * | 1/2011 | Nikols | 40/324 |
| 2006/0075670 | A1 * | 4/2006 | Brinkman | 40/666 |

FOREIGN PATENT DOCUMENTS

| | | |
|---|---|---|
| EP | 0 510 942 | 10/1992 |
| JP | 4-91831 | 8/1992 |

(Continued)

OTHER PUBLICATIONS

International Search Report issued Nov. 13, 2012 in International (PCT) Application No. PCT/JP2012/005045.

*Primary Examiner* — David Fidei
(74) *Attorney, Agent, or Firm* — Wenderoth, Lind & Ponack, L.L.P.

(57) ABSTRACT

A tray unit having a tray that is open at the top and a card holder mounted to the outer peripheral face of the tray. The tray has a bottom face, an outer peripheral wall that rises upward from the outer peripheral part of the bottom face, and a flange extending from the upper face side of the outer peripheral wall in the outer peripheral direction. The card holder has a card insertion portion along the outer peripheral wall of the tray and to the outside of the outer peripheral wall, and to which a card is removably inserted, and a guide portion that is provided at the upper part of the card insertion portion and has formed thereon a sloped face that increases in height from the outer peripheral wall of the tray in the outer peripheral direction of the tray.

4 Claims, 6 Drawing Sheets

(51) Int. Cl.

| | |
|---|---|
| ***B65D 85/00*** | (2006.01) |
| ***G09F 3/20*** | (2006.01) |
| ***B65D 21/02*** | (2006.01) |
| ***B65D 25/20*** | (2006.01) |
| ***B65D 1/34*** | (2006.01) |

(56) References Cited

FOREIGN PATENT DOCUMENTS

| | | |
|---|---|---|
| JP | 5-168650 | 7/1993 |
| JP | 2010-70214 | 4/2010 |

* cited by examiner

TRAY UNIT AND CARD HOLDER

BACKGROUND OF THE INVENTION

1. Field of the Invention

The present invention relates to a tray unit for holding and conveying pharmaceuticals and other such objects, for example, and to a card holder that is used in this tray unit and in which a card denoting patient information or the like is inserted.

2. Description of the Related Art

Conventional tray units have been used, for example, in the drug dispensing devices, and were configured as follows.

Specifically, a conventional tray unit comprised a tray that was open at the top, and a card holder that was mounted to the outer peripheral face of the tray.

This tray is in the form of a container having a bottom face and an outer peripheral wall that rises upward from the outer peripheral part of the bottom face. The interior of the tray is divided into a plurality of spaces as necessary by dividers (see Patent Document 1, for example).

CITATION LIST

Patent Literature

Japanese Laid-Open Patent Application H5-168650

SUMMARY OF THE INVENTION

Problem to be Solved by the Invention

When the above-mentioned conventional tray held pharmaceuticals or other such objects, for example, it was preferable if a card denoting information about the objects (such as a drug name) was inserted, so that the worker handling the tray (such as a nurse) could easily confirm the information about the objects, etc.

One way to deal with this is to provide the tray with a card insertion portion that allows a card to be inserted, for example.

However, if a card insertion portion is merely mounted to the tray, there is the risk that the card insertion portion or the card will be damaged when the tray is actually used.

More specifically, when the top tray is pulled out from a stack of trays provided with card insertion portions, there is the risk that part of the top tray being pulled out will interfere with the card insertion portion mounted on the lower side, or with a card inserted therein.

In view of this, it is an object of the present invention to provide a tray unit and a card holder with which damage to the card insertion portion or to the card inserted therein can be prevented.

To achieve the stated object, the tray unit of the present invention comprises a tray that is open at the top, and a card holder mounted to the outer peripheral face of the tray. The tray has a bottom face, an outer peripheral wall that rises from the outer peripheral part of the bottom face in a direction intersecting the bottom face, and a flange that extends from the side of the outer peripheral wall that is away from the bottom face, toward the outside of the tray. The card holder has a card insertion portion and a guide portion. The card insertion portion is provided along the outer peripheral wall of the tray and to the outside of the outer peripheral wall, and a card is removably inserted into this card insertion portion. The guide portion is provided at the upper part of the card insertion portion and includes a sloped face that increases in height from the outer peripheral wall side of the tray toward the outside of the tray, and the upper end of the sloped face is disposed at a position higher than the upper end part of the card inserted in the card insertion portion.

Effects

With the tray unit of the present invention, when the top tray is pulled out of a stack of trays, the tray will be taken out while the bottom face of the top tray slides on the sloped face provided to the upper part of the card insertion portion of the lower tray. This prevents the bottom portion, etc., of the upper tray from coming into contact with the card insertion portion of the lower tray or with the card inserted therein. As a result, damage to the card insertion portion or the card during use of the tray can be prevented.

DETAILED DESCRIPTION OF THE INVENTION

The tray unit pertaining to an embodiment of the present invention will now be described through reference to the drawings.

Figure 1:
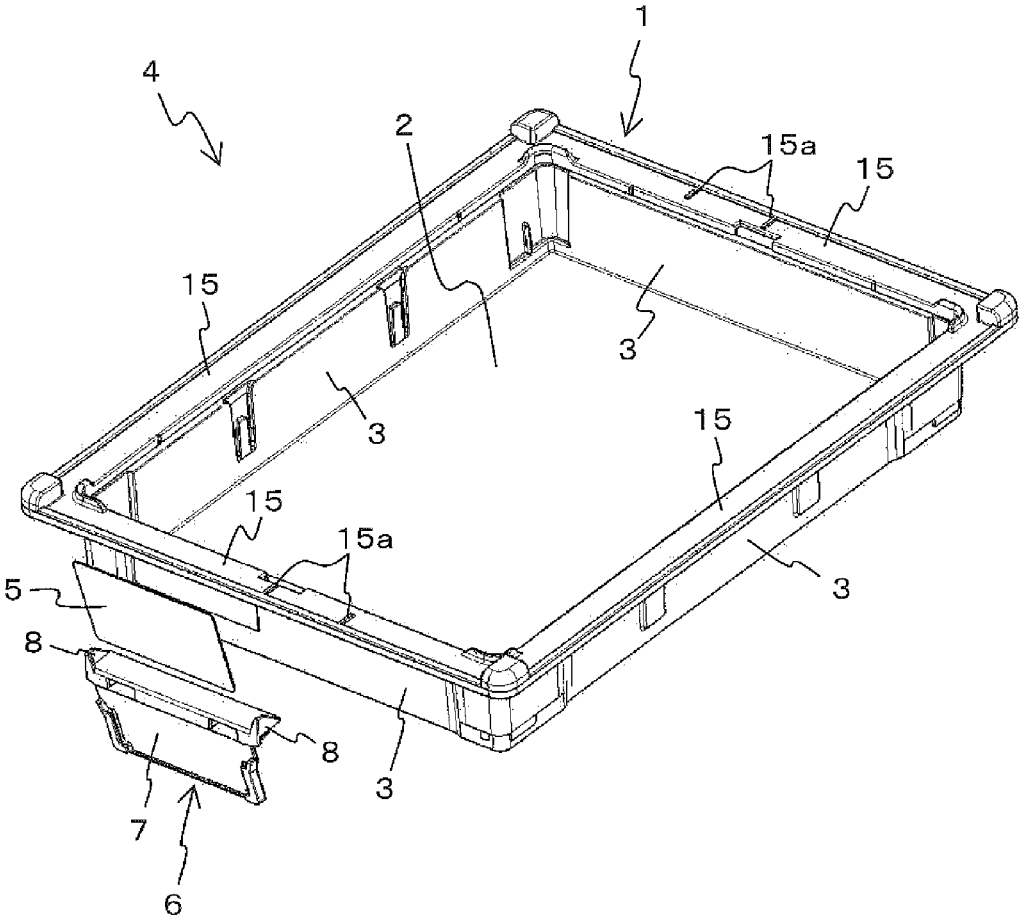
FIG. 1 is an exploded oblique view of the tray unit in an embodiment of the present invention.

FIG. 1 is an exploded oblique view of the tray unit in an embodiment of the present invention.

Figure 2A:
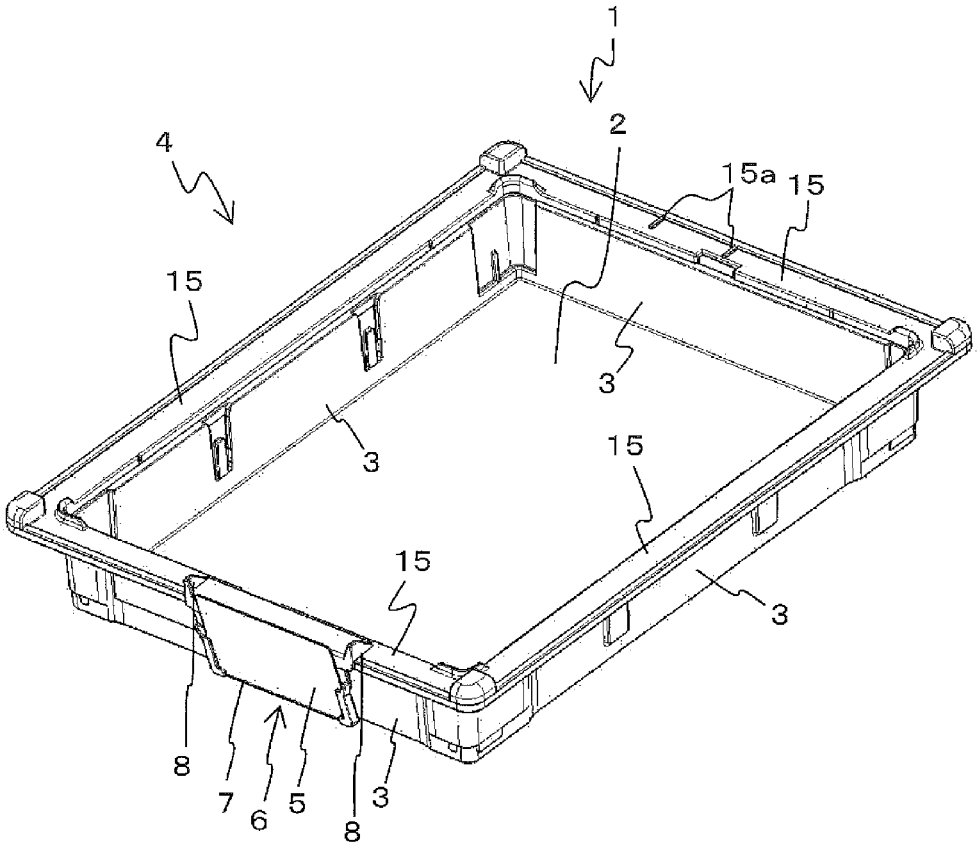
FIG. 2*a* is an oblique view of the tray unit in FIG. 1.

FIG. 2*a* is an oblique view of the tray unit in an embodiment of the present invention.

In FIGS. 1 and 2*a*, a tray unit 4 comprises a tray 1 for conveying pharmaceuticals that is open at the top, a card 5, and a card holder 6 into which the card 5 is removably inserted. Tray 1

As shown in FIGS. 1 and 2*a*, the tray 1 is shaped like a container. The tray 1 also has an outer peripheral wall 3 and a flange 15.

The outer peripheral wall 3 is made up of four faces that constitute an approximate rectangle in plan view, which rise up from the outer peripheral part of a substantially rectangular bottom face 2.

The flange 15 is formed so as to extend in the outer peripheral direction from the upper end part of the outer peripheral wall 3.

Furthermore, the tray 1 has first convex portions 15*a* on the upper faces of the flange 15 disposed at the upper parts of the outer peripheral walls 3 that form faces on the short sides, out of the four faces that make up an approximate rectangle in plan view.

Figure 2B:
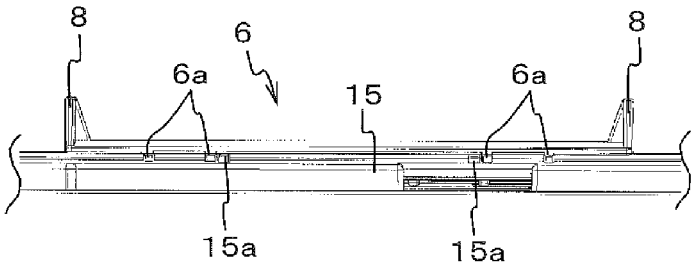
FIG. 2*b* is an enlarged rear view of the engaged portion between the card holder and the tray.

The first convex portions 15*a* are provided so as to protrude upward at two places each on the upper faces of the flange 15 on the short sides of the approximate rectangle in plan view. The first convex portions 15*a* mesh with four second convex portions 6*a* formed on the inner faces of engagement portions 9 of a card holder 6 (discussed below), as shown in FIG. 2*b*, when the card holder 6 has been mounted to the flange 15. This allows the card holder 6 to be positioned when the card holder 6 is attached to the tray 1.

Card 5

The card 5 is an information display on which information about a pharmaceutical contained in the tray 1 (such as the pharmaceutical name, the name of the patient to be given that pharmaceutical, and so forth) is written. In this embodiment, what is known as a rewritable card (which can be rewritten a number of times) is used as the card 5.

Card Holder 6

As shown in FIGS. 1 and 2*a*, the card holder 6 has a card insertion portion 7 for removably holding the card 5 as mentioned above, and guide portions 8 provided to the upper part of the card insertion portion 7.

Figure 3:
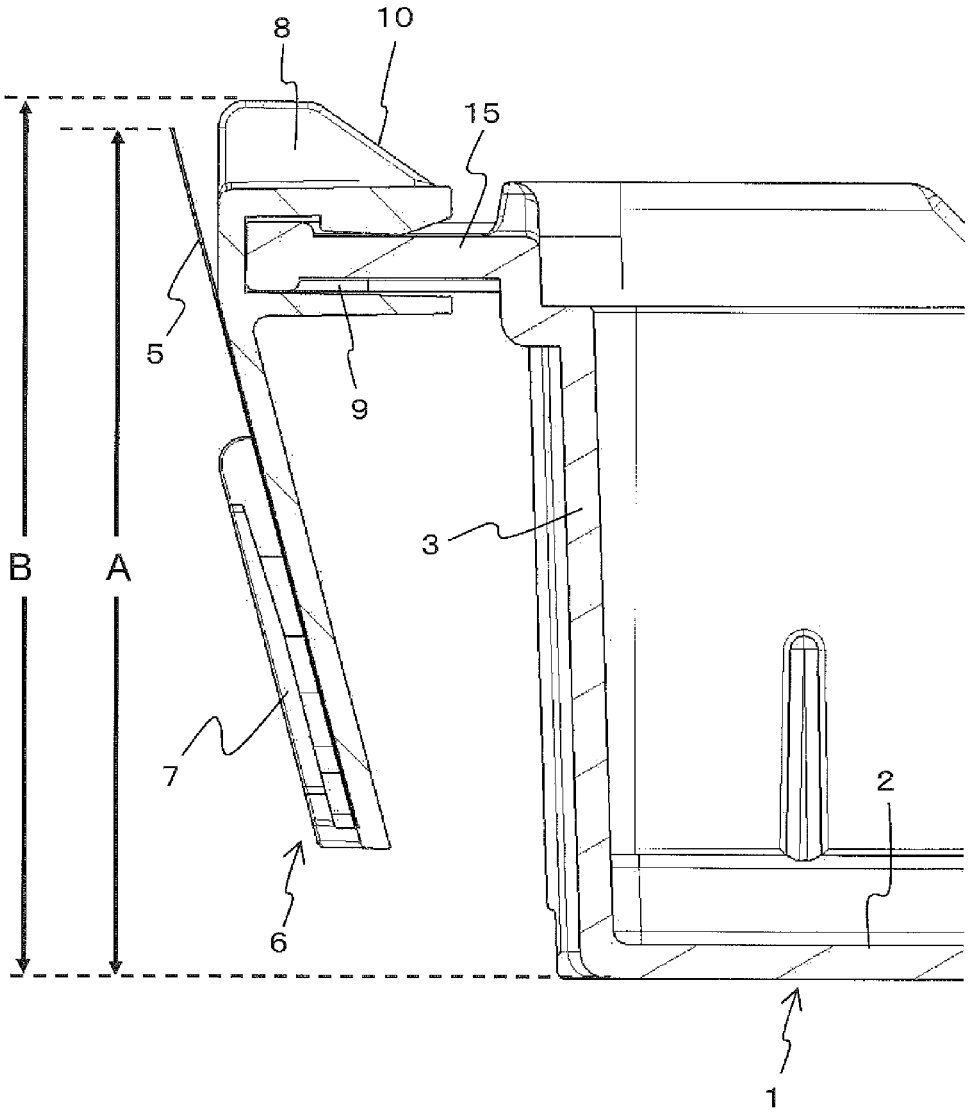
FIG. 3 is a partial detail cross section of the tray unit in FIG. 1.

FIG. 3 is a partial detail cross section of the tray unit 4 in this embodiment.

As shown in FIG. 3, in the card holder 6, the engagement portions 9, which detachably engage with the flange 15 of the tray 1, are provided to the upper part of the card insertion portion 7. The card holder 6 and the tray 1 can be attached to and removed from the flange 15 via the engagement portions 9.

In this embodiment, the engagement portions 9 are provided to the upper part of the card insertion portion 7. Furthermore, the guide portions 8 are provided to the upper part of the engagement portions 9.

The engagement portions 9 hold the flange 15 of the tray 1 so that the flange 15 is sandwiched within a substantially U-shaped gap in cross sectional view. Protruding portions are formed at the substantially U-shaped distal end portions in the engagement portions 9. Consequently, the protruding portions of the engagement portions 9 engage with convex portions formed at the outer peripheral part of the flange 15 of the tray 1, and the card holder 6 is mounted to the tray 1.

The engagement portions 9 also have four second convex portions 6*a* that protrude toward the upper face of the flange 15, at the portion opposite the upper face of the flange 15 of the tray 1 on the substantially U-shaped inner face in cross sectional view.

The second convex portions 6*a* are provided two each at positions slightly to the inside from both the left and the right ends in the width direction of the card holder 6. Consequently, when the first convex portions 15*a* on the tray 1 side engage with the second convex portions 6*a* on the card holder 6 side, the card holder 6 is positioned with respect to the tray 1, and the card holder 6 is prevented from sliding sideways after being mounted to the tray 1.

The card insertion portion 7 is provided along the outer peripheral wall 3 and to the outside of the outer peripheral wall 3 of the tray 1, when the card holder 6 has been mounted to the tray 1. The card insertion portion 7 is disposed so as to be substantially parallel to the outer peripheral wall 3.

Consequently, since the card 5 is mounted to the card holder 6 in a state in which the display face is tilted slightly down, the user of the tray unit 4 (such as a nurse) can easily check what is written on the card 5.

Also, in the card holder 6, the guide portions 8 are provided to the upper part of the engagement portions 9 and the card insertion portion 7. As shown in FIG. 3, the guide portions 8 have a sloped face 10 that increases in height from the outer peripheral wall 3 side of the tray 1 toward the outside of the tray 1.

As shown in FIG. 3, the sloped faces 10 are formed such that the highest position is higher than the upper end portion of the card 5 inserted into the card holder 6.

The function of the sloped faces 10 will be discussed in detail at a later point.

Usage State of Tray Unit 4

The state in which the tray unit 4 is used will now be described through reference to FIGS. 3 to 6.

Figure 4:
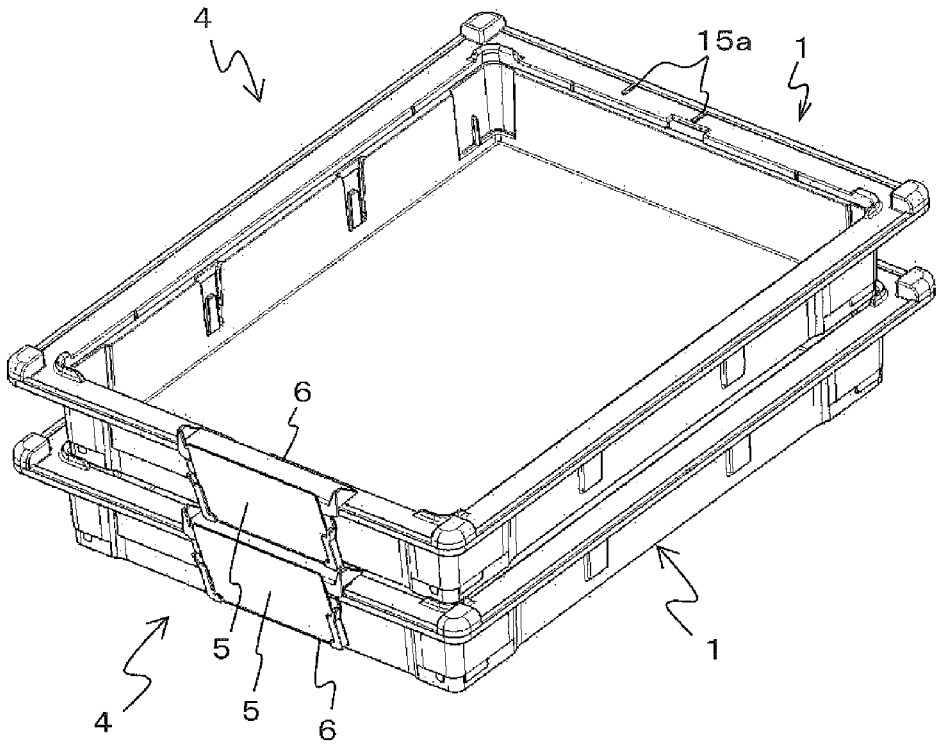
FIG. 4 is an oblique view of a usage state of the tray unit in FIG. 1.
Figure 5:
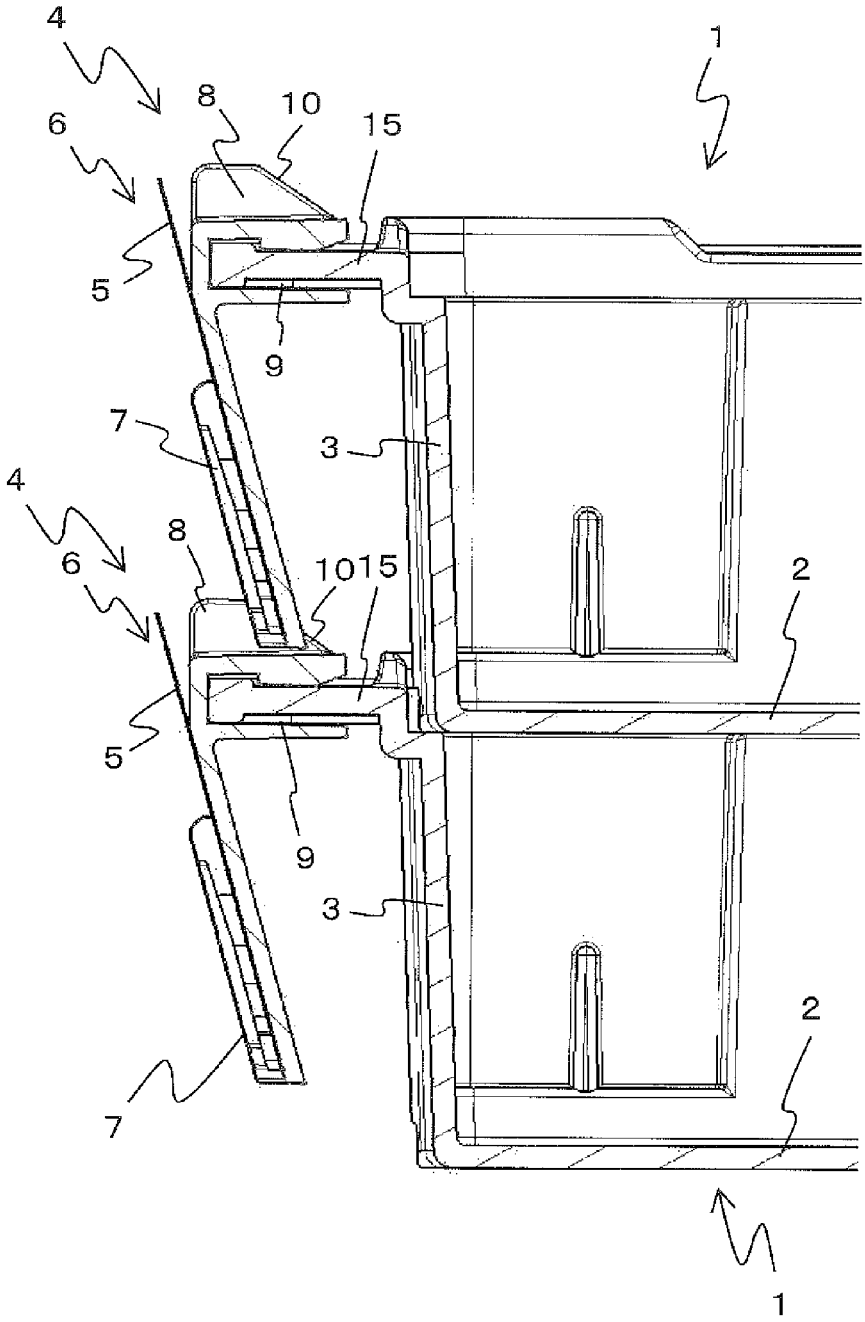
FIG. 5 is a partial detail cross section of a usage state of the tray unit in FIG. 1.
Figure 6:
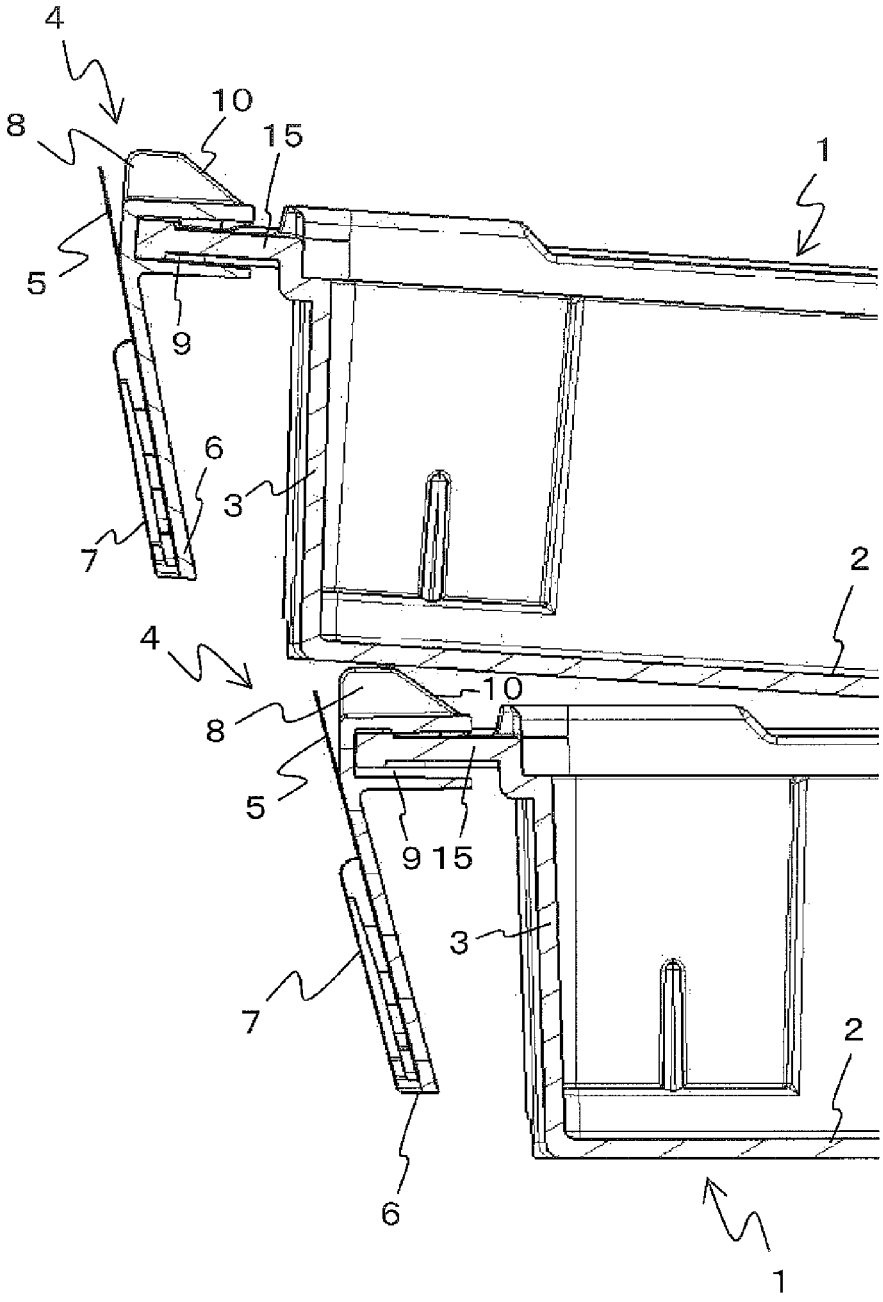
FIG. 6 is a partial detail cross section of another usage state of the tray unit in FIG. 1.

FIG. 4 is an oblique view of a usage state of the tray unit 4 in this embodiment. FIG. 5 is a partial detail cross section of the tray unit in this embodiment. FIG. 6 is a partial detail cross section of the tray unit 4 in another usage state in this embodiment.

First, the terms used herein will be defined.

The phrase "the height of the card 5 in the tray unit 4" means the height corresponding to A in FIG. 3, which is the height from the bottom face 2 of the tray 1 to the upper end portion of the card 5 in a state in which the card 5 has been inserted into the card insertion portion 7 of the card holder 6 mounted to the tray 1.

The phrase "the height of the end of the tray unit 4" means the height from the bottom face 2 of the tray 1 to the upper end portion of the tray unit 4 in a state in which the card holder 6 has been mounted to the tray 1. More precisely, this substantially means the height corresponding to B in FIG. 3, which is the height from the bottom face 2 of the tray 1 to the upper end portion of the guide portions 8 of the card holder 6.

In this embodiment, the guide portions 8 are provided so that the height B of the end of the tray unit 4 will be higher than the height A of the card 5 in the tray unit 4. Specifically, the guide portions 8 are disposed so that A<B in FIG. 3.

Next, the usage state of the tray unit 4 will be described in more detail.

As shown in FIGS. 4 and 5, in a hospital or the like, the tray unit 4 is generally used in a state in which a plurality of (two in FIG. 4) tray units 4 are stacked.

As shown in FIG. 6, when the top tray unit 4 is taken out from a state in which two tray units 4 are stacked (in FIG. 6, when the top tray unit 4 is pulled out to the left), the tray unit 4 is taken out in the following state.

Specifically, when the top tray unit 4 is pulled out from a state in which the two tray units 4 are stacked up and down, the bottom face 2 of the top tray unit 4 slides over the sloped faces 10 of the guide portions 8 on the lower tray unit 4 until it is over the upper end faces of the guide portions 8 on the lower tray unit 4 (see FIG. 6).

The sloped faces 10 here are formed so that their height increases from the outer peripheral wall 3 of the tray 1 toward the outside of the tray 1. The sloped faces 10 increase in height from a position that is lower than the upper end portion of the card 5 toward the outside of the tray 1, and are ultimately formed at a position that is higher than the upper end portion of the card 5.

Consequently, when the top tray unit 4 is pulled out of the stacked tray units 4, the sloped faces 10 guide the bottom face 2 of the top tray unit 4 up above the upper end portion of the card 5. This prevents the bottom face 2 of the tray unit 4 that is pulled out from coming into contact with the card 5 or the card insertion portion 7 of the lower tray unit 4. As a result, damage to the card insertion portion 7 or to the card 5 inserted therein can be effectively prevented during use of the trays.

Furthermore, the guide portions 8 are not in the form of simple protrusions, but instead are provided with sloped faces 10 so that the height increases from the outer peripheral wall 3 of the tray 1 toward the outside of the tray 1. Accordingly, the tray unit 4 stacked on top can be pulled out easily and smoothly toward the user. As a result, the job of checking pharmaceuticals and so forth contained in the tray units 4, for example, can be performed more easily.

Also, in this embodiment, as shown in FIGS. 1 and 2*a*, the guide portions 8 are disposed at the upper part of the card insertion portion 7, at the left and the right ends to the outside of the card insertion portion 7.

Consequently, as shown in FIG. 2*a*, the upper end portion of the card 5 can stick up to a position higher than the flange 15 of the tray 1. As a result, the work is facilitates when inserting and removing the card 5 into and from the card insertion portion 7. Specifically, when the user of the tray unit 4 is putting in the card 5, the upper end of the card 5 inserted into the card insertion portion 7 of the card holder 6 can be easily grasped and inserted or removed.

Furthermore, as shown in FIG. 2*b*, with the tray unit 4 in this embodiment, the first and the second convex portions 15*a* and 6*a* are formed on the tray 1 side and the card holder 6 side, respectively. Consequently, in a state in which the card holder 6 is mounted to the tray 1, the first and the second convex portions 15*a* and 6*a* are engaged with each other, which positions the card holder 6 with respect to the flange 15 of the tray 1, and also prevents the card holder 6 from shifting to the left or the right after being mounted to the tray 1.

As a result, for example, even if a card 5 that has been rewritten is inserted back into the card insertion portion 7 by a robot arm or the like, since the position of the card holder 6 with respect to the tray 1 is accurately established, the card 5 can be accurately inserted into the card insertion portion 7.

Other Embodiments (A)

In the above embodiment, an example was given in which the guide portions 8 were provided to the upper part of the card holder 6, and the card holder 6 could be mounted to the tray 1, but the present invention is not limited to this.

For example, the guide portions 8 may be formed directly on the flange 15 of the tray 1.

However, if the configuration is such that the guide portions 8 are provided to the upper part of the card holder 6 and the card holder 6 can be mounted, as in this embodiment, there is no need to provide the guide portions 8 on the tray 1 side. This makes the tray 1 more universal (for example, the type and size of the tray 1 and the tray unit 4, and whether or not a card is used, can be selected according to the user's wishes), and the tray 1 can also have a simpler configuration.

This also makes the tray 1 easier to wash, so it is preferable for the guide portions 8 provided to the upper part of the card holder 6, and for the card holder 6 to be mountable to the tray, as in this embodiment.

(B)

In the above embodiment, an example was given in which the guide portions 8 were provided near both ends in the width direction at the upper part of the card insertion portion 7, but the present invention is not limited to this.

For example, a card holder 6 may be used that is provided with guide portions that have an overall block form in the width direction.

Alternatively, a card holder may be used that is provided with a guide portion only at either the left or right end in the width direction.

(C)

In the above embodiment, an example was given in which two first convex portions 15*a* and four second convex portions 6*a* for preventing lateral sliding and for positioning the card holder 6 with respect to the flange 15 of the tray 1 were provided on the flange 15 side of the tray 1 and the card holder 6 side, respectively, but the present invention is not limited to this.

For example, the number and shape of the first and second convex portions can be modified as needed, and are not limited to what is given in the above embodiment.

Industrial Applicability

The tray unit of the present invention has the effect of preventing damage to the card insertion portion and the card inserted therein during tray use, so the present invention is expected to find application to trays and so forth that can hold pharmaceuticals and other such objects.

REFERENCE SIGNS LIST

1 tray
2 bottom face
3 outer peripheral wall
4 tray unit
5 card
6 card holder
6*a* second convex portion
7 card insertion portion
8 guide portion
9 engagement portion
10 sloped face
15 flange
15*a* first convex portion

The invention claimed is:

1. A tray unit, comprising:

a tray that is open at the top; and a card holder mounted to an outer peripheral face of the tray, wherein the tray has:

a bottom face;

an outer peripheral wall that rises from an outer peripheral part of the bottom face in a direction intersecting the bottom face; and a flange that extends from a side of the outer peripheral wall that is away from the bottom face, toward an outside of the tray, and wherein the card holder has:

a card insertion portion along the outer peripheral wall of the tray and to an outside of the outer peripheral wall, and configured to accept a removably inserted card; and a guide portion at an upper part of the card insertion portion, the guide portion having a sloped face that increases in height from the outer peripheral wall of the tray toward the outside of the tray, the sloped face having an upper end that higher than an upper end part of the removably inserted card inserted in the card insertion portion.

2. The tray unit according to claim 1, wherein the card holder further comprises an engagement portion configured to detachably engage with the flange of the tray.

3. The tray unit according to claim 2, wherein the flange of the tray has a first convex portion, and the card holder has a second convex at a position corresponding to the first convex portion at the engagement portion, and engages with the first convex portion.

4. A card holder that is to be mounted in a removable state to a container-like tray, the card holder comprising:

a card insertion portion configured to accept a removably inserted card;

an engagement portion, on an upper part of the card insertion portion, and configured to engage with the tray; and a guide portion at an upper part of the engagement portion, the guide portion having a sloped face that increases in height from an outer peripheral wall of the tray toward an outside of the tray, the sloped face reaching a position higher than an upper end part of the removably inserted card inserted in the card insertion portion.

* * * * *